US008739578B2

(12) United States Patent
Kim et al.

(10) Patent No.: US 8,739,578 B2
(45) Date of Patent: Jun. 3, 2014

(54) WASHING MACHINE WITH A LIQUID DETERGENT MIXER

(75) Inventors: Kyeong Hwan Kim, Seoul (KR); Il Hyeon Jo, Seoul (KR); Jin Ho Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 880 days.

(21) Appl. No.: 12/450,509

(22) PCT Filed: Mar. 29, 2008

(86) PCT No.: PCT/KR2008/001777

§ 371 (c)(1),
(2), (4) Date: Dec. 17, 2009

(87) PCT Pub. No.: WO2008/120930

PCT Pub. Date: Oct. 9, 2008

(65) Prior Publication Data

US 2010/0088828 A1 Apr. 15, 2010

(30) Foreign Application Priority Data

Mar. 31, 2007 (KR) ..... 10-2007-0032081

(51) Int. Cl.
*D06F 39/02* (2006.01)
*D06F 39/12* (2006.01)

(52) U.S. Cl.
CPC ..... *D06F 39/022* (2013.01); *D06F 39/125* (2013.01)
USPC ..... 68/17 R; 68/207

(58) Field of Classification Search
CPC ..... D06F 39/022; D06F 39/125
USPC ..... 68/12.18, 17 R, 207
See application file for complete search history.

(56) References Cited

U.S. PATENT DOCUMENTS

| | | | | |
|---|---|---|---|---|
| 3,804,297 | A * | 4/1974 | Jurjans | 222/54 |
| 5,014,211 | A * | 5/1991 | Turner et al. | 700/239 |
| 6,349,440 | B1 | 2/2002 | Amberg et al. | |
| 8,056,374 | B2 * | 11/2011 | Hoppe | 68/12.18 |
| 2006/0021393 | A1 * | 2/2006 | Oda et al. | 68/231 |
| 2006/0117811 | A1 * | 6/2006 | Kinnetz | 68/17 R |
| 2006/0272360 | A1 * | 12/2006 | Hsu et al. | 68/19 |
| 2009/0090141 | A1 * | 4/2009 | Deppermann et al. | 68/17 R |

FOREIGN PATENT DOCUMENTS

| | | | |
|---|---|---|---|
| DE | 2739792 | A * | 3/1979 |
| DE | 3238529 | A1 | 4/1984 |
| DE | 87 11 341 | U1 | 9/1988 |
| DE | 38 22 246 | A1 | 1/1990 |
| EP | 0 077 463 | A2 | 4/1983 |
| EP | 0 849 391 | A1 | 6/1998 |
| EP | 1 728 912 | | 12/2006 |
| FR | 2.127.176 | | 10/1972 |

(Continued)

*Primary Examiner* — Joseph L Perrin
(74) *Attorney, Agent, or Firm* — McKenna Long & Aldridge LLP

(57) ABSTRACT

A washing machine and a method of controlling the washing machine are provided. In the washing machine and the method of controlling the washing machine, a liquid detergent is automatically supplied into a washing tub, thereby improving user convenience. In addition, in the washing machine and the method of controlling the washing machine, a liquid detergent is supplied into the washing tub by water supplied by a water supply unit. Thus, no liquid detergent remains in a liquid detergent supply path, and the liquid detergent supply path can be prevented from being blocked due to the solidification of a liquid detergent.

7 Claims, 6 Drawing Sheets

(56) References Cited

FOREIGN PATENT DOCUMENTS

| | | | |
|---|---|---|---|
| FR | 2 515 220 | A1 | 4/1983 |
| FR | 2 785 302 | A1 | 5/2000 |
| GB | 2 111 021 | A | 6/1983 |
| GB | 2127045 | A | 4/1984 |
| JP | 07-068081 | | 3/1995 |
| JP | 63-043698 | | 2/1998 |
| KR | 0117560 | | 7/1998 |
| KR | 0123622 | | 12/1998 |
| KR | 0123724 | | 12/1998 |

* cited by examiner

WASHING MACHINE WITH A LIQUID DETERGENT MIXER

This application is a National Stage Entry of International Application No. PCT/KR2008/001777, filed on Mar. 29, 2008, and claims the benefit of Korean Patent Application No. 10-2007-0032081, filed Mar. 31, 2007, both of which are hereby incorporated by reference for all purposes as if fully set forth herein in their entireties.

TECHNICAL FIELD

The present invention relates to a washing machine and a method of controlling the same, and more particularly, to a washing machine and a method of controlling the same, in which a liquid detergent can be automatically supplied into a washing tub while preventing the liquid detergent from remaining in a path of the supply of the liquid detergent.

BACKGROUND ART

In general, washing machines remove dust and dirt from clothing by performing a mechanical operation using water and a detergent. In recent years, an increasing number of washing machines have been equipped with a drier function for drying wet laundry with the use of a mechanical operation and hot wind generated by a heater.

A typical washing machine includes a washing tub, which is rotatably installed in the typical washing machine and can contain water and laundry therein. The typical washing machine performs a washing operation on laundry contained in the washing tub by rotating the washing tub with the aid of a driving unit. The typical washing machine also includes a water supply unit which supplies water into the washing tub, and a drainage unit which drains water from the washing tub. A detergent supply unit, which supplies a detergent into the washing tub, is disposed on a water supply path of the water supply unit. The detergent supply unit includes a dispenser which is connected to the water supply path and a detergent box which is installed so as to be able to be inserted into or ejected from the dispenser. Therefore, in order to supply a powder detergent or a liquid detergent into the washing tub, the detergent box may be taken out from the dispenser, a powder detergent or a liquid detergent may be injected into the detergent box, and the detergent box may be put back in the disperser. Then, if the water supply unit begins to operate, the powder detergent or the liquid detergent contained in the detergent box may be supplied into the washing tub along with water that flows along the water supply path of the water supply unit.

Conventionally, however, users are required to put a liquid detergent into a detergent box whenever necessary for a washing operation, thereby causing inconvenience and reducing the convenience of the use of a washing machine.

DISCLOSURE OF INVENTION

Technical Problem

The present invention provides a washing machine which can automatically supply a liquid detergent into a washing tub while preventing the liquid detergent from remaining in a liquid detergent supply path.

Technical Solution

According to an aspect of the present invention, there is provided a washing machine including a washing tub which contains water therein; a water supply unit which supplies water into the washing tub; a liquid detergent container which contains a liquid detergent therein; and a liquid detergent supply unit which supplies the liquid detergent into the water supply unit and injects a mixture of the liquid detergent and the water supplied by the water supply unit into the washing tub.

According to another aspect of the present invention, there is provided a washing machine including a washing tub which contains water therein; a first supply path along which water is supplied from an external water source into the washing tub; liquid detergent container which contains a liquid detergent therein; and a second supply path along which a mixture of the liquid detergent and the water supplied from the external water source is supplied into the washing tub.

According to another aspect of the present invention, there is provided a method of controlling a washing machine, the method including automatically supplying a liquid detergent into a liquid detergent mixer; and supplying water from an external water source into the liquid detergent mixer, mixing the liquid detergent with the water, and injecting the mixture of the liquid detergent and the water into a washing tub.

According to the present invention, it is possible to improve user convenience by automatically supplying a liquid detergent into a washing tub. In addition, it is possible to prevent a liquid detergent from remaining in a liquid detergent supply path and prevent the liquid detergent supply path from being blocked due to the solidification of a liquid detergent by supplying a liquid detergent into a washing tub with the use of water supplied by a water supply unit.

Moreover, according to the present invention, it is possible to prevent a waste of liquid detergent and the deterioration of the performance of a washing machine by precisely controlling the amount of liquid detergent supplied into a washing tub.

BRIEF DESCRIPTION OF THE DRAWINGS

The above and other features and advantages of the present invention will become more apparent by describing in detail preferred embodiments thereof with reference to the attached drawings in which.

MODE FOR THE INVENTION

The present invention will hereinafter be described in detail with reference to the accompanying drawings in which exemplary embodiments of the invention are shown.

Figure 1:
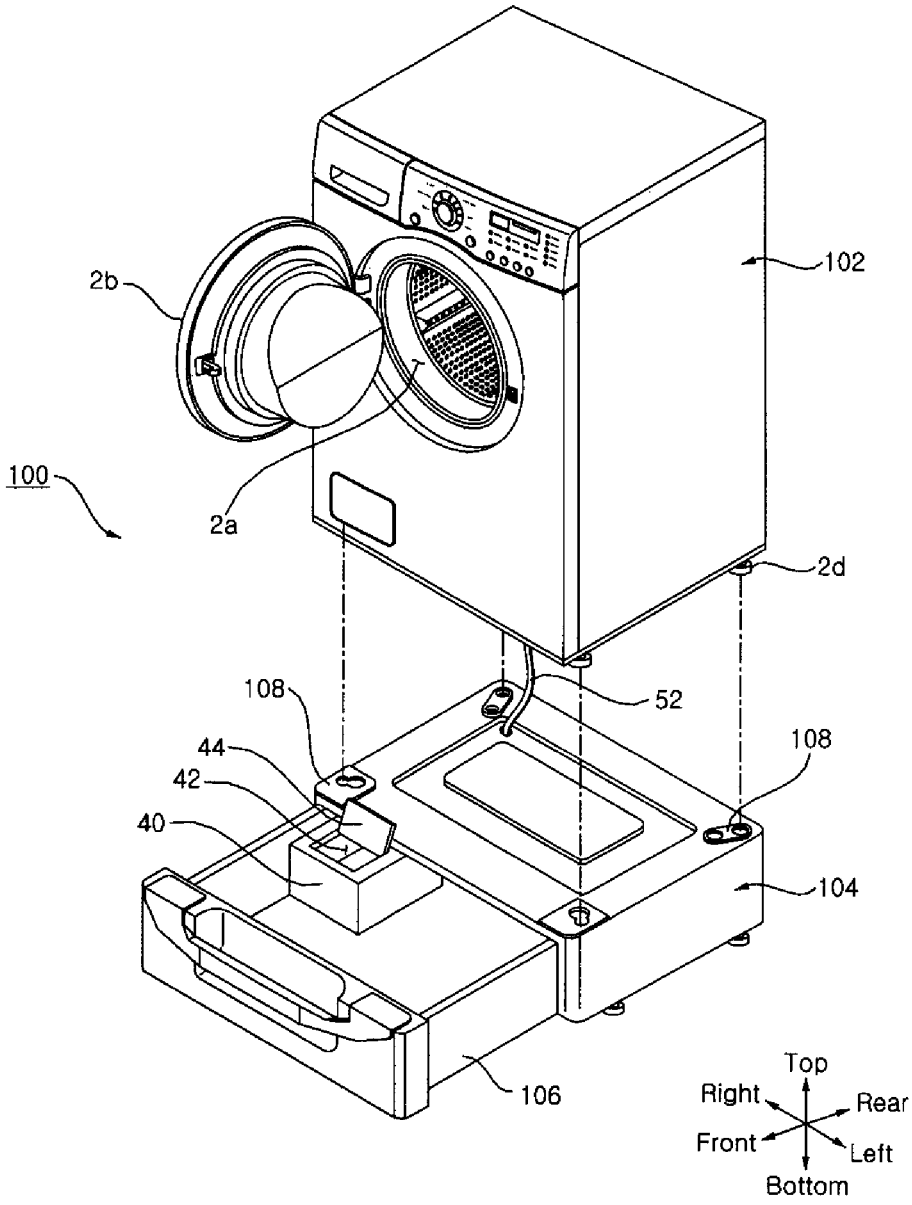
FIG. 1 illustrates a perspective view of a drum-type washing machine according to an embodiment of the present invention.

FIGS. 1 through 4 illustrate diagrams of a drum-type washing machine 100 according to an embodiment of the present invention. Referring to FIG. 1, the drum-type washing machine 100 includes a main body 102 which performs a washing operation on laundry; and a frame 104 which is disposed on one side of the main body 102 and contains various stuffs necessary for the use of the main body 102.

A laundry inlet/outlet hole 2*a*, through which laundry can be injected into or ejected from the main body 102, is formed at the front of the main body 102. A door 2*b* is rotatably installed so as to be able to open or close the laundry inlet/outlet hole 2*a*. A plurality of legs 2*d*, which support the main body 102, are formed at the bottom of the main body 102. A drawer-type container 106 is installed so as to be able to slide in and out of the frame 104. The drawer-type container 105 may be ejected forward from the frame 104.

The frame 104 may be selectively disposed on the top, the bottom, a left side, a right side, or a rear side of the main body 102. In the embodiment of FIGS. 1 through 4, the frame 104 is disposed below the main body 102. A plurality of leg settling units 108 respectively corresponding to the legs 2*d* are formed on the top of the frame 104. Once the main body 102 is mounted on the frame 104, the laundry inlet/outlet hole 2*a* is lifted up by as much as the height of the frame 104, and thus a user can easily access the main body 102. Therefore, the frame 104 not only contains various goods but also lifts up the main body 102 to the extent that the convenience of the use of the main body 102 can be improved.

Figure 2:
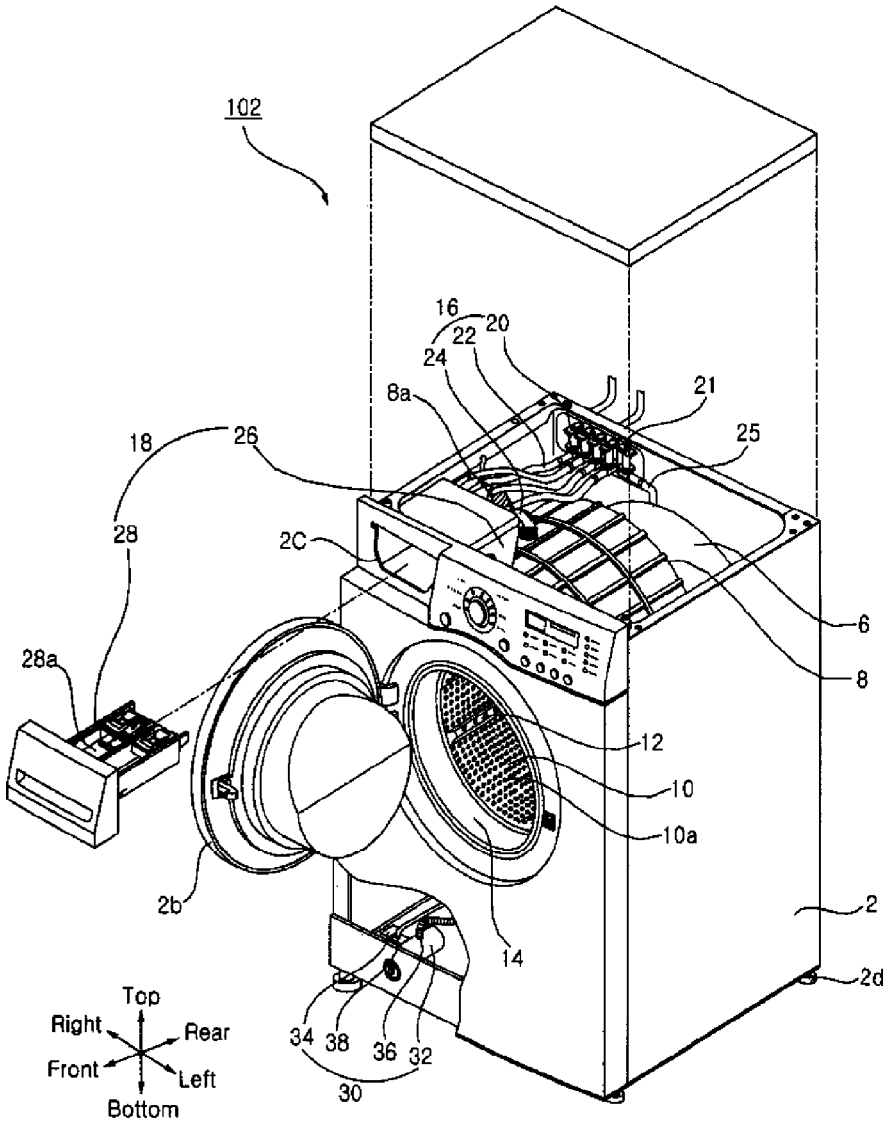
FIG. 2 illustrates a partially exploded perspective view of a main body of the drum-type washing machine illustrated in FIG. 1.
Figure 3:
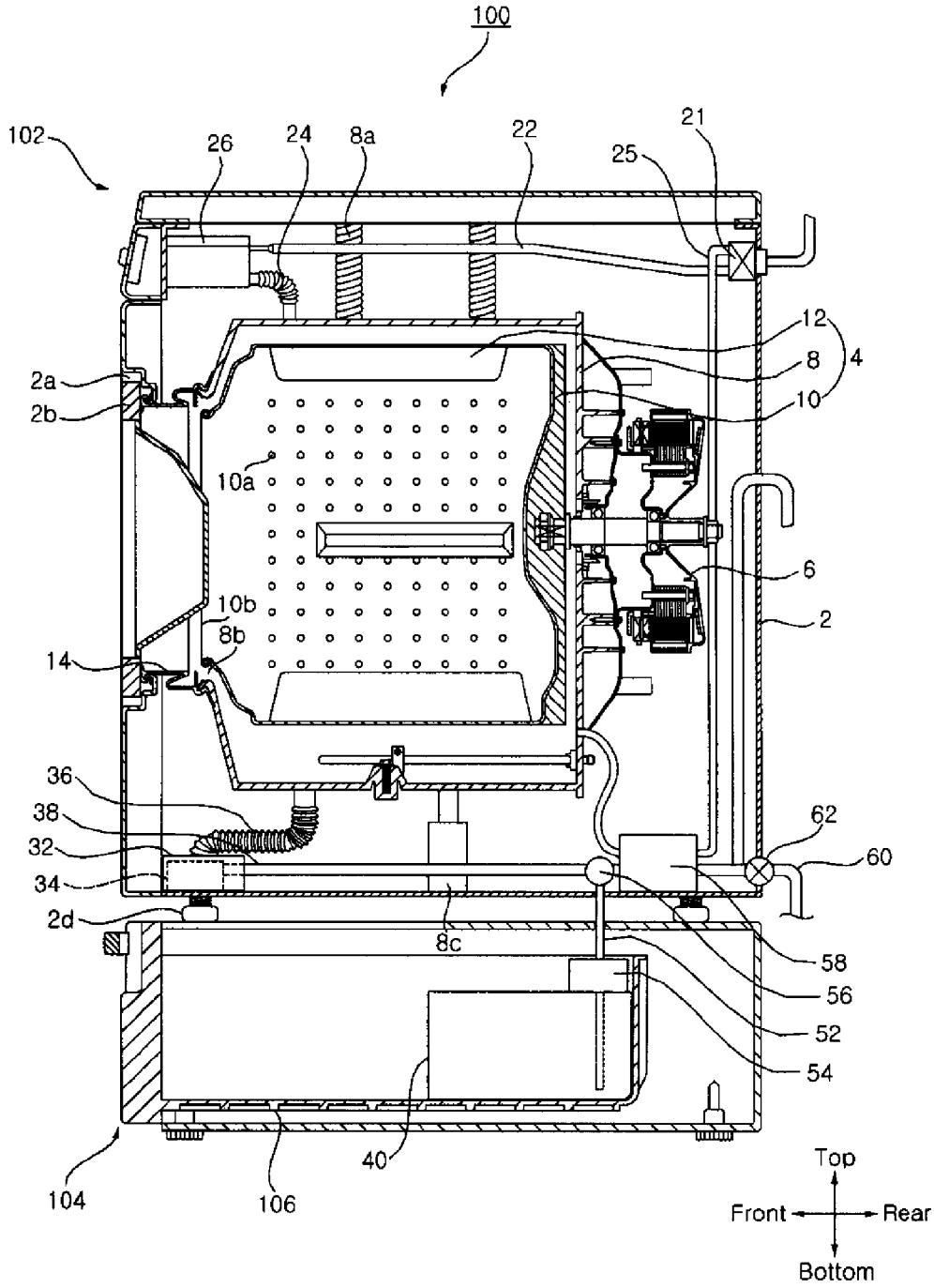
FIG. 3 illustrates a cross-sectional view of the drum-type washing machine illustrated in FIG. 1.

Referring to FIGS. 2 and 3, the main body 102 includes a case 2 which forms the exterior of the main body 102, a washing tub 4 which is rotatably installed in the case 2 and contains laundry, a detergent and water, and a driving unit 6 which drives the washing tub 4.

The washing tub 4 may include a tub 8 which is installed so as to be able to be buffered by a spring 8*a* and a damper 8*c* and contains water and a detergent therein; a drum 10 which is rotatably installed in the tub 8, contains laundry and includes a plurality of water holes 10*a* through which water and a detergent contained in the tub 8 can pass; and a lifter 12 which is disposed in the drum 10 and lifts up and drops laundry during the rotation of the drum 10.

An opening 8*b* is formed at the front of the tub 8, and an opening 10*b* is formed at the front of the drum 10. The laundry inlet/outlet hole 2*a* is formed at the front of the case 2 and faces the openings 8*b* and 10*b*. The door 2*b* is rotatably installed at the front of the case 2. A gasket 14 is disposed between the opening 8*b* of the tub 8 and the laundry inlet/outlet hole 2*a*. The gasket 14 alleviates shock caused by the rotation of the drum 10 and prevents a water spill.

Referring to FIGS. 2 and 3, the main body 102 also includes a water supply unit 16 which is disposed above the tub 8 and supplies water into the tub 8; and a detergent supply unit 18 which is disposed on a water supply path of the water supply unit 16 and supplies a detergent into the tub 8.

The water supply unit 16 may includes a plurality of water supply valves 20 which are disposed in the case 2 and are connected to an external water source, and a plurality of water supply paths which are disposed between the respective water supply valves 20 and the tub 8 and guide water into the tub 8. The water supply paths includes a plurality of first water supply hoses 22 which connect the respective water valves 20 to the detergent supply unit 18 and a second water supply hose 24 which connects the detergent supply unit 18 and the tub 8.

The water supply unit 16 includes a liquid detergent supply valve 21 which is disposed on one side of the water supply valves 20 and is connected to an external water source; and a third water supply hose 25 which is disposed between the liquid detergent supply valve 21 and the tub 8 and is connected to a liquid detergent supply unit 50. The third water supply hose 25 has one end connected to the liquid detergent supply valve 21 and the other end connected to a lower portion of the tub 8. Part of the third water supply hose 25 is disposed below the tub 8 and connected to the liquid detergent supply unit 50.

The detergent supply unit 18 is provided with a detergent by a user before the operation of the drum-type washing machine 100 and supplies the detergent into the tub 8 during the operation of the drum-type washing machine 100. The detergent supply unit 18 includes a dispenser 26 and a detergent box 28 which is installed in the dispenser 26 so as to be able to be inserted into or ejected from the dispenser 26 and includes a plurality of detergent containers 28*a* into which a detergent can be supplied by the user. The first water supply hoses 22 are connected to the top of the dispenser 26, and the second water supply hoses 24 are connected to the bottom of the dispenser 26.

The dispenser 26 has an open front and is connected to a hole 2*c*, which is formed at the front of the case 2. The detergent box 28 is disposed so as to be able to be inserted into or ejected from the dispenser 26 through the hole 2*c* of the case 2. Therefore, the dispenser 26 selectively distributes water supplied thereto through the first water supply hoses 22 among the detergent containers 28*a* and then supplies water mixed with a detergent in the detergent containers 28*a* into the tub 8 through the second water supply hoses 24. A powder detergent, a liquid detergent or both may be supplied into the detergent supply unit 18.

Figure 4:
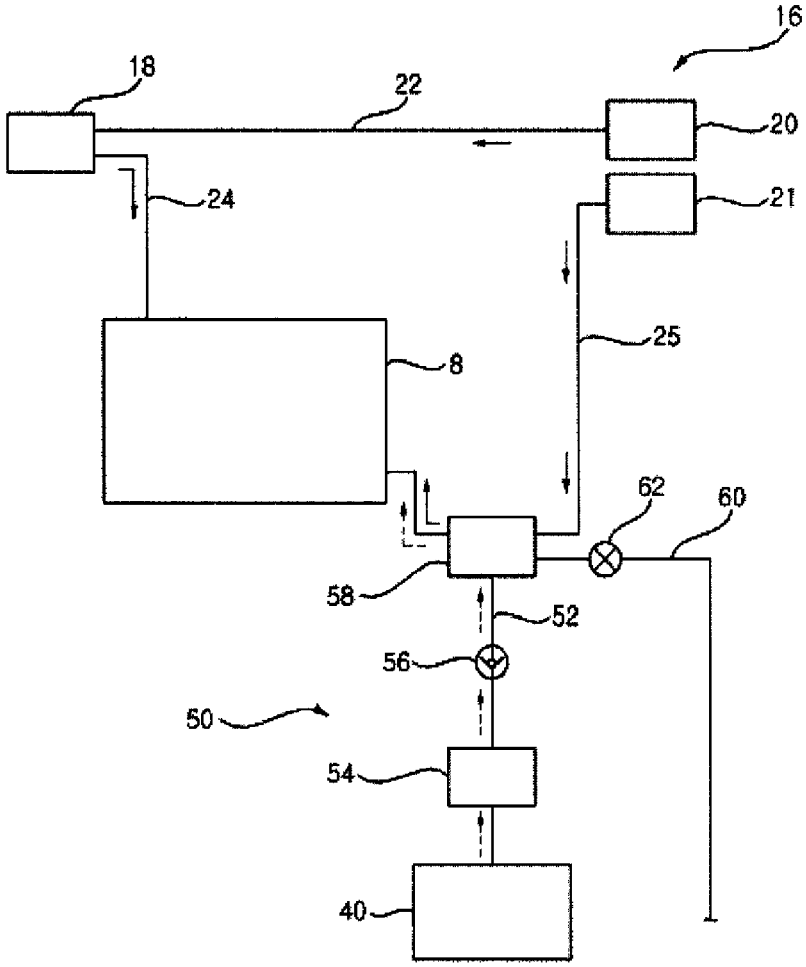
FIG. 4 illustrates a block diagram of the drum-type washing machine illustrated in FIG. 1.

Referring to FIGS. 2, 3 and 4, the main body 102 also includes a drainage unit 30, which is disposed below the tub 8 and drains water and a detergent from the tub 8. The drainage unit 30 includes a drain path which guides water in the tub 8 to the outside of the case 2; a drain filter 32 which is disposed on the drain path and removes foreign materials from drain water; and a drain pump 34 which is disposed in the drain filter 32 and flows water along the drain path. The drain path includes a first drain hose 36 which connects a lower portion of the tub 8 and the drain filter 32 and a second drain hose 38 which has one end connected to the drain filter 32 and the other end disposed outside the case 2.

Referring to FIGS. 1 and 3, the frame 104 also includes at least one liquid detergent container 40 which contains at least one type of liquid detergent to be supplied into the tub 8. The liquid detergent container 40 is disposed in the drawer-type container 106. A number of liquid detergent containers 40 corresponding to the number of types of liquid detergents used in a washing operation may be provided in the drum-type washing machine 100. In the embodiment of FIGS. 1 through 4, only one liquid detergent container 40 is provided in the drum-type washing machine 100, and only one type of liquid detergent is used in a washing operation performed by the drum-type washing machine 100. The liquid detergent container 40 includes an injection hole 42 which is formed on the top of the liquid detergent container 40 and through which a liquid detergent is injected into the liquid detergent container 40. A cover 44 is formed so as to be able to open and close the injection hole 42. When the drawer-type container 106 is ejected from the dispenser 108, the injection hole 42 is completely exposed.

Referring to FIGS. 3 and 4, the drum-type washing machine 100 also includes the liquid detergent supply unit 50 which automatically supplies a liquid detergent contained in the liquid detergent container 40 into the tub 8. The liquid detergent supply unit 50 automatically supplies an appropriate amount of liquid detergent into the tub 8 according to the amount of laundry in the drum 10. Therefore, the supply of a detergent by the detergent supply unit 18 may not be performed.

Referring to FIGS. 1, 3 and 4, the liquid detergent supply unit 50 includes a liquid detergent supply path 52 which connects the liquid detergent container 40 and the water supply unit 16; and a liquid detergent supply pump 54 which is disposed on the liquid detergent supply path 52.

The liquid detergent supply path 52 has a first end connected to the liquid detergent container 40 in the frame 104 and a second end connected to the third water supply hose 25 of the water supply unit 16 in the main body 102. The second end of the liquid detergent supply path 52 is connected to a lowermost portion of the third water supply hose 25, but the present invention is not restricted to this. That is, the second end of the liquid detergent supply path 52 may be connected to various portions of the third water supply hose 25, other than the lowermost portion of the third water supply hose 25, or may be connected directly to the liquid detergent supply valve 21.

The liquid detergent supply path 52 passes through the top of the frame 104 and the bottom of the main body 102. Therefore, the liquid detergent supply path 52 may be divided into more than one portion that can be selectively connected to or disconnected from each other, thereby facilitating the installation of the liquid detergent supply path 52 in the drum-type washing machine 100. The liquid detergent supply path 52 may be formed as a hose having a sufficient length to not interfere with the ejection of the drawer-type container 106.

The liquid detergent supply pump 54 pumps a liquid detergent out of the liquid detergent container 40, which is disposed below the tub 8, and thus forcefully flows the liquid detergent into the third water supply hose 25 through the liquid detergent supply path 52. The liquid detergent supply pump 54 is disposed in the frame 104. The liquid detergent supply pump 54 may be disposed in the main body 102.

The amount of liquid detergent supplied by the liquid detergent supply unit 50 is controlled according to the number of revolutions per minute of the liquid detergent supply pump 54 and the duration of the operation of the liquid detergent supply pump 54. In the embodiment of FIGS. 1 through 4, the number of revolutions per minute of the liquid detergent supply pump 54 is uniformly maintained, and thus, the amount of liquid detergent supplied by the liquid detergent supply pump 54 is determined according to the duration of the operation of the liquid detergent supply pump 54. That is, once the amount of liquid detergent to be supplied is set according to the amount of laundry injected into the drum 10 and a washing course, the liquid detergent supply pump 54 is continuously driven for an amount of time corresponding to the set amount of liquid detergent, and thus, the set amount of liquid detergent can be supplied into the tub 8.

Referring to FIGS. 3 and 4, the liquid detergent supply unit 50 also includes a check valve 56, which is disposed on the liquid detergent supply path 52 and limits the direction of the flow of a liquid detergent from the liquid detergent container 40 to the third supply hose 25. That is, the check valve 56 prevents water and foreign materials in the third water supply hose 25 from flowing into the liquid detergent container 40 along the liquid detergent supply path 52 when the liquid detergent supply valve 21 is open. The check valve 56 is disposed between the liquid detergent supply pump 54 and the third water supply hose 25 in order to prevent the liquid detergent supply pump 54 from being affected by the water-supply pressure of an external water source, which is connected to the liquid detergent supply valve 21. Thus, it is possible to prevent the liquid detergent supply pump 54 from being damaged due to pressure caused by water supplied into the liquid detergent supply valve 21.

Referring to FIGS. 3 and 4, the liquid detergent supply unit 50 also includes a liquid detergent mixer 58, which is connected to the connection between the liquid detergent supply path 52 and the water supply unit 16 and mixes a liquid detergent with water. The liquid detergent mixer 58 is formed as a cylinder having an empty space therein. The liquid detergent mixer 58 is connected to the liquid detergent supply path 52, and thus, a liquid detergent that flows along the liquid detergent supply path 52 can be injected into the liquid detergent mixer 58. In addition, the liquid detergent mixer 58 is connected to a middle portion of the third water supply hose 25, and thus, water that flows along the third water supply hose 25 can be injected into the liquid detergent mixer 58 and mixed with the liquid detergent injected into the liquid detergent mixer 58. Then, the liquid detergent mixer 58 supplies a liquid detergent completely dissolved in water into the tub 8 through the third water supply hose 25.

As the difference between the height of the liquid detergent mixer 58 and the height of the liquid detergent container 40 increases, the pump head of the liquid detergent supply pump 54 increases. Accordingly, the required capacity of the liquid detergent supply pump 54 increases, and the manufacturing cost of the liquid detergent supply pump 54 increases. Therefore, the liquid detergent mixer 58 may be disposed between the tub 8 and the liquid detergent container 8 so as to be as close as possible to the liquid detergent container 40.

The liquid detergent mixer 58 also includes a remaining water discharge path 60 which discharges water remained in the third water supply hose 25 and the liquid detergent mixer 58 when the operation of the drum-type washing machine 100 is terminated; and a remaining water discharge valve 62 which is disposed on the remaining water discharge path 60. The remaining water discharge path 60 has one end connected to the liquid detergent mixer 58 and the other end disposed outside the case 2. The remaining water discharge valve 62 is closed during the operation of the drum-type washing machine 100, and can thus prevent a liquid detergent and water from leaking through the remaining water discharge path 60. When the operation of the drum-type washing machine 100 is terminated, the remaining water discharge valve 62 is opened and thus discharges water remained in the third water supply hose 25 and the liquid detergent mixer 58.

The operation of the drum-type washing machine 100 will hereinafter be described in detail. Assume that the detergent supply unit 18 supplies no detergent, and that the liquid detergent supply unit 50 supplies a liquid detergent instead.

Laundry is injected into the drum 10 through the laundry inlet/outlet hole 2*a* of the main body 102, and the door 2*b* is closed so that the laundry inlet/outlet hole 2*a* can be sealed. Then, the main body 102 is driven. The main body 102 detects the amount of laundry injected into the drum 10, and sets a feed-water level, an amount of detergent to be supplied, and a washing time.

Thereafter, the liquid detergent supply unit 50 is driven and thus supplies water into the tub 8 until reaching the set feed-water level. More specifically, the liquid detergent supply pump 54 of the liquid detergent supply unit 50 is driven and thus pumps a liquid detergent out of the liquid detergent container 40. Then, the liquid detergent flows into the liquid detergent mixer 58 through the liquid detergent supply path 52. Thereafter, the liquid detergent supply valve 21 is opened so that water can be supplied from an external water source into the liquid detergent mixer 58 through the third water supply hose 25. Then, the water is mixed with the liquid detergent in the liquid detergent mixer 58, and the mixture is supplied into the tub 8.

Thereafter, the water supply unit 16 is driven and thus supplies water into the tub 8 until reaching the set feed-water level. More specifically, the water supply valve 20 of the water supply unit 16 is opened so that water can be supplied into the tub 8 through the first water supply hose 22, the detergent supply unit 18 and the second water supply hose 24.

Once the supply of a liquid detergent and water into the tub 8 is complete, the driving unit 6 is driven so that the drum 10 can rotate for a predefined amount of time. Accordingly, a washing operation is performed while repeatedly lifting up and dropping the laundry with the use of the rotation of the drum 10 and the lifter 12.

Once the washing operation is complete, the operation of the driving unit 6 is terminated, and the drainage unit 30 is driven and thus drains water from the tub 8. Thereafter, the water supply unit 16 is driven and thus supplies water into the tub 8 until reaching the set feed-water level. Thereafter, the driving unit 6 is driven and thus rotates the drum 10 again, thereby performing a rinsing operation.

Once the rinsing operation is complete, the operation of the driving unit 6 is terminated, and the drainage unit 30 is driven and thus drains water from the tub 8. Thereafter, if the tub 8 is completely drained, the driving unit 6 is driven and thus rotates the drum 10 at high speed, and then, the operation of the drum-type washing machine 100 is terminated. When the drum 10 is rotated at high speed, water drains from the laundry, and water collected in the tub 8 is discharged by the drainage unit 30.

The supply of a liquid detergent as performed in the drum-type washing machine 100 will hereinafter be described in detail with reference to FIG. 4. Referring to FIG. 4, solid-line arrows indicate water flow caused by the water supply unit 16, and dotted-line arrows indicate water flow caused by the liquid detergent supply unit 50.

Referring to FIG. 4, the liquid detergent supply pump 54 is driven and thus pumps a liquid detergent out of the liquid detergent container 40. Then, the liquid detergent flows along the liquid detergent supply path, and thus, a predefined amount of liquid detergent is supplied into the liquid detergent mixer 58.

The amount of liquid detergent supplied by the liquid detergent supply pump 54 may be determined indirectly based on the duration of the operation of the liquid detergent supply pump 54. Therefore, if the duration of the operation of the liquid detergent supply pump 54 is more than a predefined amount of time, the operation of the liquid detergent supply pump 54 is terminated. The predefined amount of time may be set according to the amount of laundry, a washing course and the type of liquid detergent used in the drum-type washing machine 100. Alternatively, the amount of liquid detergent supplied by the liquid detergent supply pump 54 may be measured by installing a water level sensor or a weight sensor in the liquid detergent container 40.

If an appropriate amount of liquid detergent is injected into the liquid detergent mixer 58, the liquid detergent supply valve 21 is opened so that water can be supplied into the third water supply hose 25. The water supplied by the liquid detergent supply valve 21 is injected into the tub 8 through the third water supply hose 25. The water that flows along the third water supply hose 25 is injected into the liquid detergent mixer 58 and is thus mixed with the liquid detergent in the liquid detergent mixer 58. Then, the mixer is supplied from the liquid detergent mixer 58 into the tub 8 through the third water supply hose 25. In short, the mixture of water and a liquid detergent is supplied into the tub 8 by the liquid detergent supply valve 21, the third water supply hose 25 and the liquid detergent supply unit 50.

In the embodiment of FIGS. 1 through 4, the liquid detergent supply unit 50 and the water supply unit 16 supply a liquid detergent mixed with water into the tub 8 and thus prevent laundry in the drum 10 from directly contacting a liquid detergent. Therefore, it is possible to prevent laundry from being damaged or decolorized due to directly contacting a liquid detergent. In addition, in the embodiment of FIGS. 1 through 4, a liquid detergent is supplied into the tub 8 by being dissolved in water supplied by the water supply unit 16, and thus, no liquid detergent remains in the liquid detergent supply unit 50 and the water supply unit 16. Therefore, since a liquid detergent only remains in the tub 8, it is possible to supply an appropriate amount of liquid detergent into the tub 8, to prevent the liquid detergent supply path 52 of the liquid detergent supply unit 50 and the water supply paths of the water supply unit 16 from being blocked due to the solidification of a liquid detergent remained therein.

Figure 5:
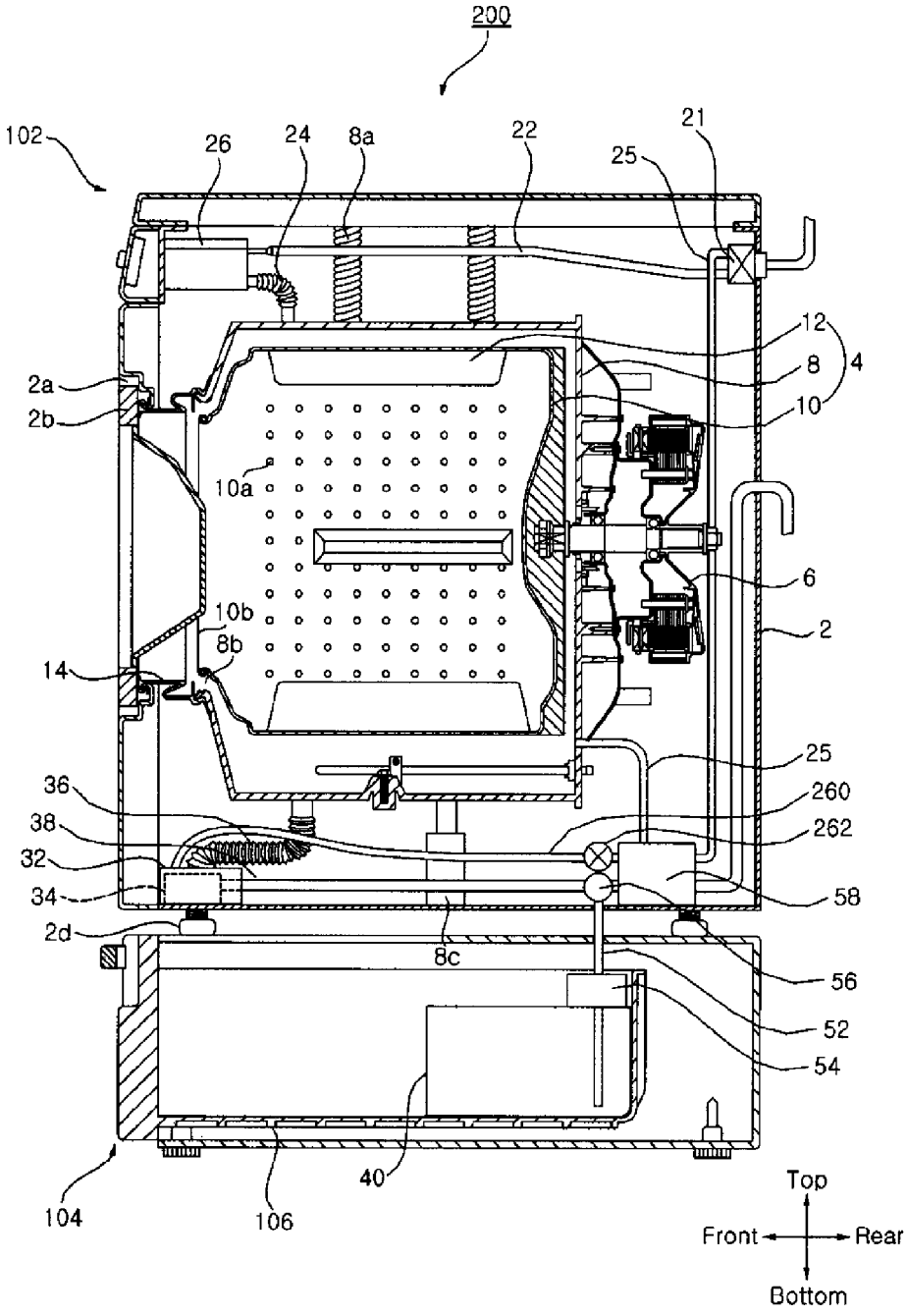
FIG. 5 illustrates a cross-sectional view of a drum-type washing machine according to another embodiment of the present invention.
Figure 6:
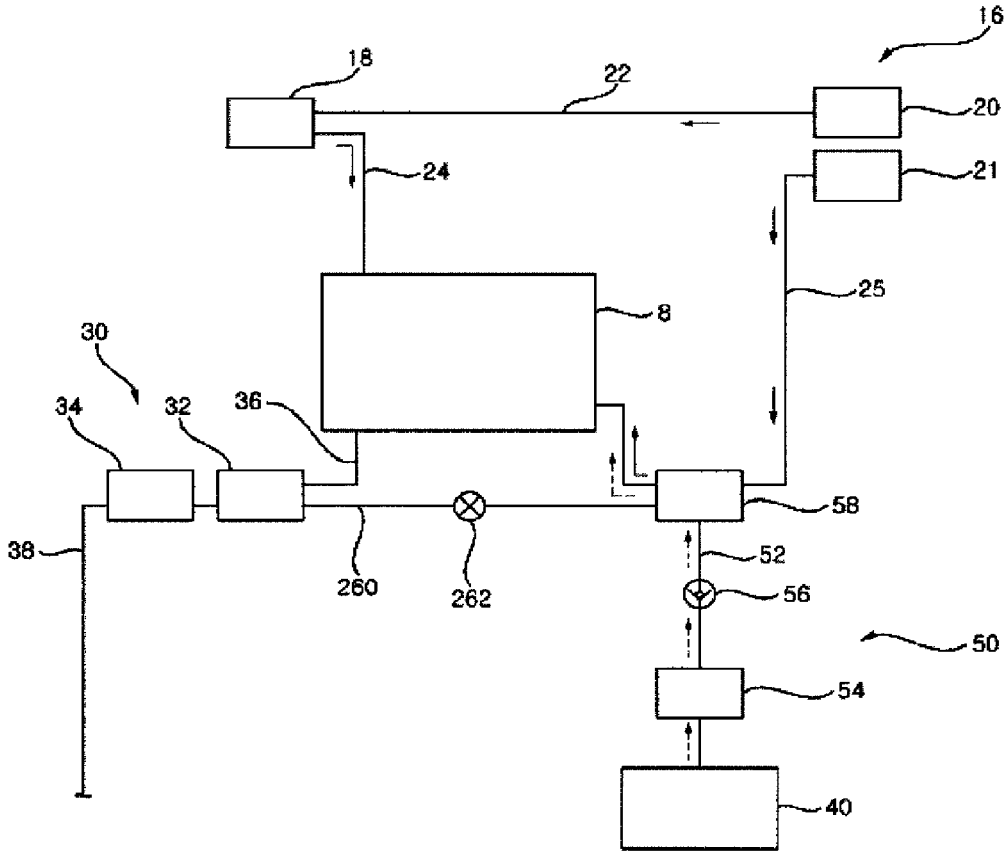
FIG. 6 illustrates a block diagram of the drum-type washing machine illustrated in FIG. 5.

FIG. 5 illustrates a cross-sectional view of a drum-type washing machine 200 according to another embodiment of the present invention, and FIG. 6 illustrates a block diagram of the drum-type washing machine 200. In FIGS. 1 through 6, like reference numerals indicate like elements, and thus detailed descriptions thereof will be skipped. The drum-type washing machine 200 will hereinafter be described, mainly focusing on the differences with the drum-type washing machine 100.

Referring to FIGS. 5 and 6, the drum-type washing machine 200 is different from the drum-type washing machine 100 in that a remaining water discharge path 260 is connected between a liquid detergent mixer 58 and a drainage unit 30, and that a remaining water discharge valve 262 is disposed on the remaining water discharge path 260. Referring to FIG. 6, solid-line arrows indicate water flow caused by a water supply unit 16, and dotted-line arrows indicate water flow caused by a liquid detergent supply unit 50.

More specifically, the remaining water discharge path 260 has one end connected to the liquid detergent mixer 58 and the other end connected to a drain filter 32 of the drainage unit 30. The remaining water discharge valve 262 is open during the operation of the drainage unit 30. Therefore, it is possible to discharge water remained in the liquid detergent mixer 58 and the water supply unit 16 through the remaining water discharge path 260. On the other hand, the remaining water discharge valve 262 is closed during the operation of the water supply unit 16. Therefore, it is possible to prevent water in the liquid detergent mixer 58 and the third water supply hose 25 from leaking into the drainage unit 30 and to prevent a drain pump 34 of the drainage unit 30 from being damaged by the water supply pressure of the water supply unit 16.

The present invention is not restricted to the embodiments set forth herein. In addition, the present invention is not restricted to a drum-type washing machine. That is, the present invention can be applied to a water stream-type washing machine.

In the present invention, if a liquid detergent container is disposed above a tub, a liquid detergent supply pump may be optional because a liquid detergent can be automatically supplied into the tub due to gravity. In addition, in the present invention, a liquid detergent mixer may not be provided. Then, a liquid detergent may be directly supplied into a third water supply hose of a water supply unit by a liquid detergent supply unit. Moreover, in the present invention, a washing machine may not include a frame. In this case, a main body of the washing machine may include both the liquid detergent supply unit and the liquid detergent container.

While the present invention has been particularly shown and described with reference to exemplary embodiments thereof, it will be understood by those of ordinary skill in the an that various changes in form and details may be made therein without departing from the spirit and scope of the present invention as defined by the following claims.

The invention claimed is:

1. A washing machine comprising:

a case;

a washing tub to contain water therein and installed in the case;

a water supply unit which supplies water into the washing tub;

a liquid detergent container which contains a liquid detergent therein;

a liquid detergent supply path connecting to the liquid detergent container;

a liquid detergent supply pump disposed on the liquid detergent supply path to pump the liquid detergent out of the liquid detergent container;

a liquid detergent mixer connecting the liquid detergent supply path and the water supply unit to mix the liquid detergent pumped by the liquid detergent supply pump with the water supplied by the water supply unit;

a mixing water path connecting the liquid detergent mixer and the washing tub to supply a mixture of the liquid detergent and the water in the liquid detergent mixer into the washing tub;

a remaining water discharge path connecting to the liquid detergent mixer to discharge water remained in the liquid detergent mixer to the outside of the case; and a remaining water discharge valve disposed on the remaining water discharge path;

a detergent supply unit which contains a detergent therein, wherein the water supply unit comprises, a water supply valve connected to an external water source, a first water supply hose connecting the water supply valves and the detergent supply unit, a second water supply hose connecting the detergent supply unit and the washing tub, a liquid detergent supply valve connected to an external water source, and a third water supply hose disposed between the liquid detergent supply valve and the liquid detergent mixer, further comprising:

a main body which includes the washing tub, the detergent supply unit and the water supply unit; and a frame which is disposed on one side of the main body and includes the liquid detergent container.

2. The washing machine of claim 1, wherein the water supply unit comprises a water supply path which connects the washing tub and an external water source and a water supply valve which is disposed on the water supply path, and the liquid detergent mixer is connected to at least one of the water supply path and the water supply valve.

3. The washing machine of claim 1, wherein the water supply unit is disposed above the liquid detergent container and the liquid detergent mixer is connected to an extended portion of the water supply unit below the washing tub.

4. The washing machine of claim 1, further comprising a check valve which is disposed on the liquid detergent supply path and prevents the liquid detergent from flowing backward from the water supply unit to the liquid detergent container.

5. The washing machine of claim 4, wherein the check valve is disposed between the liquid detergent supply pump and the water supply unit.

6. The washing machine of claim 1, further comprising:

a drainage unit which discharges water from the washing tub, wherein the remaining water discharge path is connected to the drainage unit.

7. The washing machine of claim 1, wherein the frame is disposed below the main body and supports the main body.

* * * * *